US007793603B2

(12) United States Patent
Hirate et al.

(10) Patent No.: US 7,793,603 B2
(45) Date of Patent: Sep. 14, 2010

(54) THREAD STAND FOR SEWING MACHINE

(75) Inventors: Masayoshi Hirate, Ichinomiya (JP); Minao Chinen, Nagoya (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 210 days.

(21) Appl. No.: 11/835,390

(22) Filed: Aug. 7, 2007

(65) Prior Publication Data

US 2008/0035782 A1 Feb. 14, 2008

(30) Foreign Application Priority Data

Aug. 10, 2006 (JP) ..... 2006-218842

(51) Int. Cl.
*D05B 43/00* (2006.01)
*D05B 35/00* (2006.01)

(52) U.S. Cl. ..... 112/302; 223/106; 242/134

(58) Field of Classification Search ..... 112/258, 112/302, 254; 242/129.5, 130, 130.2, 134–140; 223/106, 107

See application file for complete search history.

(56) References Cited

U.S. PATENT DOCUMENTS

| | | | | | |
|---|---|---|---|---|---|
| 2,574,381 | A | * | 11/1951 | Erdelyi | 112/302 |
| 2,610,599 | A | * | 9/1952 | Picciano et al. | 112/302 |
| 2,858,089 | A | * | 10/1958 | Yasui | 242/134 |
| 5,694,873 | A | * | 12/1997 | Wu | 112/302 |
| 5,829,711 | A | * | 11/1998 | Wu | 242/594 |
| 7,219,611 | B1 | * | 5/2007 | Troncoso et al. | 112/78 |

FOREIGN PATENT DOCUMENTS

| | | | |
|---|---|---|---|
| DE | 202004012028 | U1 | 11/2004 |
| FR | 1566117 | A | 5/1969 |
| JP | 56-121056 | U | 9/1981 |
| JP | 5-272047 | A | 10/1993 |
| JP | 9-239172 | A | 9/1997 |
| JP | 11-9871 | A | 1/1999 |

OTHER PUBLICATIONS

Notice of Preliminary Rejection issued in corresponding Korean application No. 10-2007-0079043, dated Aug. 28, 2008.
Office action issued in an Office Action dated Apr. 13, 2010 of corresponding German application No. 102007036033.

* cited by examiner

*Primary Examiner*—Ismael Izaguirre
(74) *Attorney, Agent, or Firm*—Rossi, Kimms & McDowell LLP

(57) ABSTRACT

Connection member integrally includes: a supporting section having a shape adapted to support a predetermined portion of a thread spool of a predetermined shape: a cylindrical portion for fixing a spool pin to the connection member by allowing one end portion of the pin to be inserted therein or thereon; and a fitting portion fittingly engageable with a mounting portion of a thread stand plate. Thus, the connection member and the spool pin are attached together to the thread stand plate with the connection member attached to the mounting portion of the thread stand plate via the fitting portion and the spool pin fitted at the one end portion to the cylindrical portion. The supporting section has a shape adapted to support predetermined portions of thread spools of at least two types having different configurations.

6 Claims, 6 Drawing Sheets

THREAD STAND FOR SEWING MACHINE

BACKGROUND OF THE INVENTION

The present invention relates to thread stands for holding thread reels or spools, each having an upper thread wound thereon, vertically upright at predetermined positions on a thread stand plate, and more particularly to thread stands for use in embroidery sewing machines and various types of industrial sewing machines.

In not only embroidery sewing machines but also industrial sewing machines, requiring upper threads, a thread stand plate 5 is provided, over a machine head, for vertically supporting a plurality of thread spools 51 each having an upper thread wound thereon as illustrated in FIG. 7. FIG. 7 shows a typical example of a conventionally-known thread stand, where the thread stand plate 5 has a plurality of spool pins 52 disposed vertically thereon as members for holding the thread spools 51 substantially upright at predetermined positions. As illustratively seen in FIG. 8, an umbrella member 53 for preventing undesired shaking movement of the thread spool 51 is fitted over the each of the spool pins 52. More specifically, with four resilient vanes of the umbrella member 53, a cone (i.e., conical winding core) 51*a* of the thread spool 51 is held against undesired shaking movement relative to the spool pin 52. Portion of the thread paid out from the thread spool 51 is first directed to an upper thread course and then directed to be supplied to a machine head. If, during that time, a slack occurs in the thread wound in the thread spool 51, the thread may sag from the outer periphery of the spool 51 so that it may get caught by a lower peripheral edge of the thread spool 51 when the upper thread is pulled up in such a sagging state. To avoid the inconvenience, the conventionally-known thread stand has a doughnut-shaped supporting ring 54, formed of felt or the like, provided on the thread stand plate 5 to fit on the spool pin 52, and the thread spool 51 is placed on such a supporting ring 54. With a lower end portion of the cone 51*a* of the thread spool 51 inserted in a central hole of the supporting ring 54 and a lower end surface 51*b* of the thread spool 51 placed in close contact with the upper surface of the supporting ring 54, as shown in FIG. 8, it is possible to prevent the thread from undesired sagging.

Heretofore, screwing has been employed most commonly as a way of fixing the spool pin 52 substantially upright on the thread stand plate 5. However, with sewing machines having a great many thread spools to be supported substantially upright, such as industrial multiH-head embroidery sewing machines, screwing the extremely the extremely many spool pins 52 would require great amounts of time and labor and hence high cost. In view of this, Japanese Patent Application Laid-open Publication No. HEI-5-272047 (hereinafter referred to as Patent Literature 1) discloses forming each spool pin of synthetic resin and resiliently fitting a base portion (lower end portion) of the spool pin into a mounting hole of the thread stand plate to thereby vertically fixing the spool pin to the thread stand. Further, Japanese Patent Application Laid-open Publication No. HEI-9-239172 (hereinafter referred to as Patent Literature 2) discloses mounting a bush 55 of synthetic resin in a mounting hole of the thread stand plate 5 and fitting a base portion (lower end portion) of the spool pin into the bush 55 so that the spool pin 52 can be firmly retained in place while resiliently deforming the bush 55 outwardly, as illustrated in FIG. 8.

The constructions disclosed in Patent Literature 1 and Patent Literature 2 identified above facilitate attachment of the spool pin to the thread stand plate, because they can vertically fix the spool pin to the thread stand plate by just inserting the spool pin into the stand plate without using screwing. However, with the construction disclosed in Patent Literature 1, where the spool pin is fitted directly into the thread stand plate and the thread spool is supported only by the spool pin and thread stand plate, mounting stability of the thread spool tends to be insufficient if the inner open space of the winding core is greater than the thickness of the spool pin. Similarly, with the construction disclosed in Patent Literature 2, where the bush 55 only supports and retains the spool pin thereon, mounting stability of the thread spool tends to be insufficient if the inner space of the winding core is greater than the thickness of the spool pin. Thus, in some of the cases where the winding core is in the form of a cone having a relatively great inner open space as in the thread spool 51 of FIG. 8, an umbrella member 53 is fitted over the spool pins 52 and a supporting ring 54 is provided on the thread stand, to enhance the mounting stability.

Recently, some new or special types of thread spools have been on the market. Such a special type of thread spool can not be vertically fixed to the thread stand with only the conventional spool pin (or combination of the spool pin and umbrella member) of the sewing machine, and a special connection member matching the special type of thread spool is required. Such a special connection member, which is supplied to each user by the same manufacturer as the special type of thread spool, is fitted on the spool pin positioned substantially upright in advance on the thread stamp plate. However, because it is necessary to use a dedicated connection member for each individual special type of thread spool and thus change the type of connection member to be used per change in the type of thread spool to be set on the sewing machine, which would involve very cumbersome operation.

SUMMARY OF THE INVENTION

In view of the foregoing, it is an object of the present invention to provide an improved thread stand which allows a thread spool to be supported with an enhanced stability without requiring subsequent mounting of a special connection member and which can facilitate attachment, to a thread stand plate, of a spool pin.

It is another object of the present invention to provide an improved thread stand which can stably support any one of thread spools of at least two different types without requiring subsequent mounting or replacement of a special connection member.

According to one aspect of the present invention, there is provided an improved thread stand for attachment to a predetermined mounting portion of a thread stand section of a sewing machine to hold a thread spool substantially upright thereon, which comprises: a rod member; and a connection member integrally including: a supporting section having a shape adapted to support a predetermined portion of a thread spool of a predetermined shape; a cylindrical portion for fixing the rod member to the connection member by allowing one end portion of the rod member to fittingly engage therewith; and a fitting portion fittingly engageable with the predetermined mounting portion of the thread stand section of the sewing machine. Thus, in the present invention, the connection member and the rod member are attached together to the thread stand section of the sewing machine with the connection member attached to the mounting portion of the thread stand section via the fitting portion and the rod member inserted at the one end portion into or onto the cylindrical portion.

Because the connection member integrally includes the supporting section, cylindrical portion and fitting portion, only attaching the connection member to the thread stand section (i.e., thread stand plate) of the sewing machine via the fitting portion allows the rod member (i.e., thread pin) to be readily attached to the thread stand section via the cylindrical portion of the connection member, and the thread spool can be supported stably with a reduced number of component parts. Further, by only inserting the one end portion of the rod member (thread pin) into or onto the cylindrical portion, the rod member (thread pin) can be attached to the thread stand section (i.e., thread stand plate) through one-touch operation. As a result, a thread spool can be supported with an enhanced stability, only through the novel attaching construction of the thread stand, without subsequent mounting of a special connection member, and, in addition, attachment, to the thread stand section (thread stand plate), of the rod member (i.e., thread pin) can be greatly facilitated.

In a preferred embodiment, the supporting section has a shape adapted to support predetermined portions of thread spools of at least two types having different shapes or configurations. With this arrangement, any one of the thread spools of at least two types having different shapes or configurations can be supported without a special connection member of one type being subsequently mounted or changed to another type.

In a preferred embodiment, the thread spools of at least two types are a thread spool of a predetermined first type and a thread spool of a predetermined second type, and the bottom of the thread spool of the first type has a diameter smaller than the bottom of the thread spool of the second type. The supporting section includes a first supporting concave portion formed around the cylindrical portion, a convex portion formed around the first supporting concave portion, and a second supporting concave portion formed around the convex portion, and the first supporting concave portion has a size adapted to receive the lower end of the thread spool of the first type while the second supporting concave portion has a size adapted to receive the lower end of the thread spool of the second type.

In a preferred embodiment, the cylindrical portion and the fitting portion are formed, on the connection member, in coaxial positional relation to each other, and, when the one end portion of the rod member is inserted into or onto the cylindrical portion, the fitting portion resiliently deforms, due to a fitting force given by the rod member, into tight fitting engagement with the predetermined mounting portion of the thread stand section (thread stand plate) of the sewing machine, so that the connection member and the rod member can be tightly fixed to the thread stand section. Thus, through the one-touch operation of inserting the rod member into or onto the cylindrical portion, the connection member and the rod member (i.e., thread pin) can be reliably fixed to the thread stand section (i.e., thread stand plate), so that attachment, to the thread stand section (thread stand plate), of the rod member (i.e., thread pin) can be facilitated even further.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE EMBODIMENTS

Figure 1:
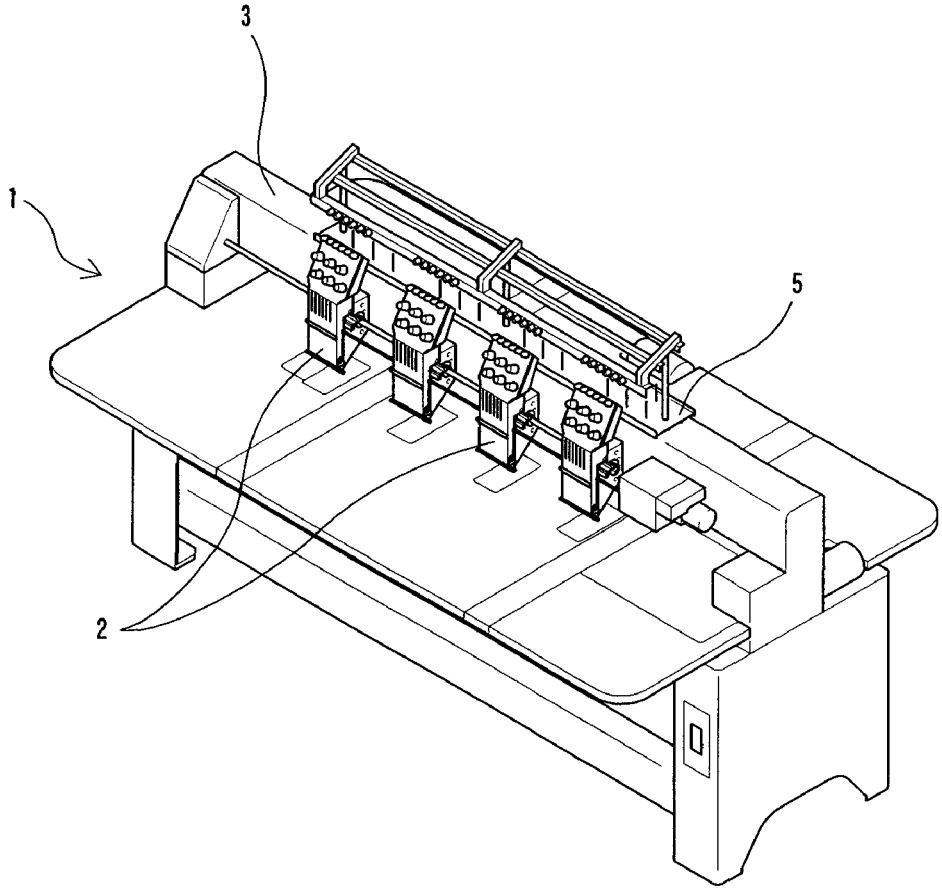
FIG. 1 is an outer appearance view showing a multi-head, multi-color embroidery sewing machine, equipped with four machine heads, as an example of a sewing machine to which is applied a thread stand according to an embodiment of the present invention.
Figure 2:
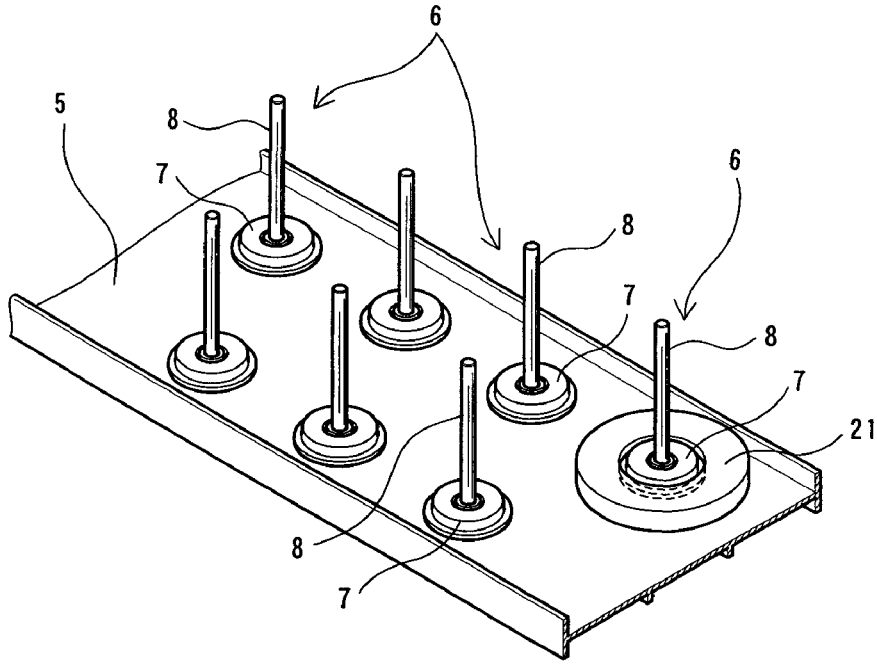
FIG. 2 is an enlarged perspective view of the embodiment of the thread stand mounted on a thread stand plate of the sewing machine of FIG. 1.

FIG. 1 is an outer appearance view of a multi-head, multi-color embroidery sewing machine 1, equipped with four machine heads, to which is applied a thread stand according to an embodiment of the present invention. Thread stand plate (thread stand section) 5 is provided on the upper surface of a machine frame 3 supporting thereon the four machine heads 2. The thread stand plate 5 is an elongated plate formed by drawing of aluminum and extending across all of the machine heads 2. As shown in enlarged scale in FIG. 2, a plurality of the thread stands 6 of the present invention are provided on the thread stand plate 5, per machine head.

Figure 3A:
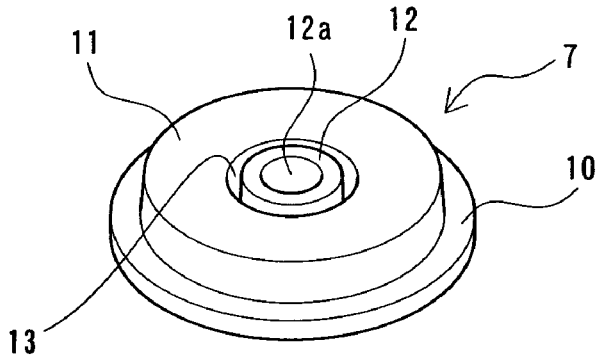
FIG. 3A is an upper perspective view of a connection member employed in the embodiment of the thread stand.
Figure 3B:
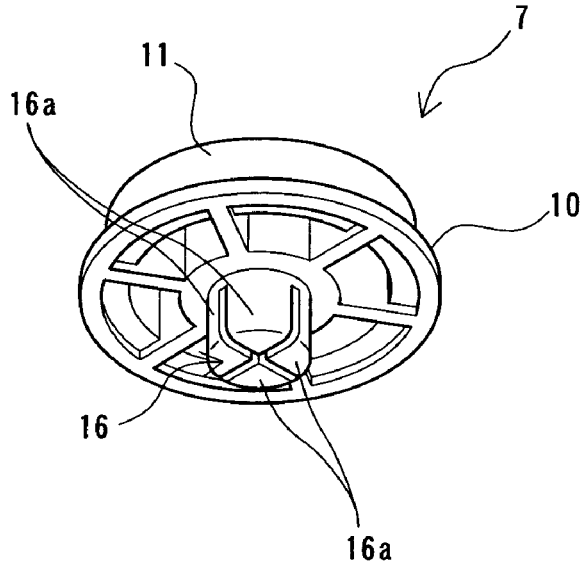
FIG. 3B is a lower perspective view of the connection member.
Figure 3C:
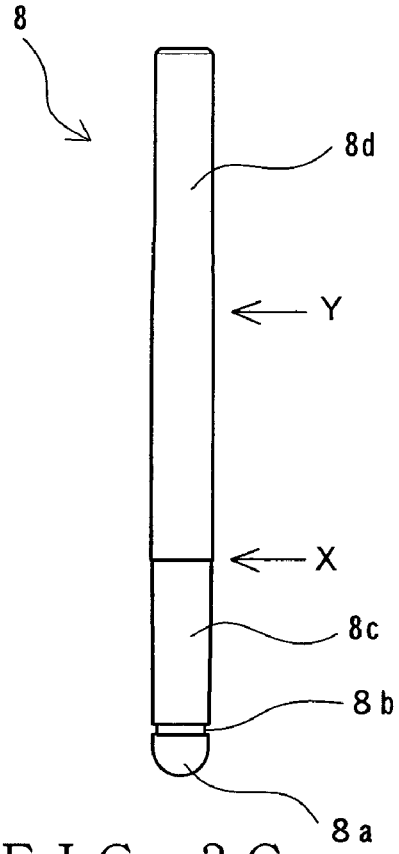
FIG. 3C is a side view of the connection member.

Each of the thread stands 6 includes a connection member 7, and a spool pin (or rod member) 8. FIG. 3A is an upper perspective view of the connection member 7, FIG. 3B is a lower perspective view of the connection member 7, and FIG. 3C is a side view of the spool pin 8. As shown in FIGS. 3A and 3B, the connection member 7 is an integrally-formed, one-piece member which integrally includes: a cylindrical portion 12 formed, in a central area of the upper surface thereof, for fixing the spool pin 8 by allowing one end portion of the spool pin 8 to be inserted into the cylindrical portion 12; supporting portions 10, 11 and 13 (these supporting portions 10, 11 and 13 together constitute a supporting section of the connection member 7) formed around the cylindrical portion 12 and having shapes adapted to support predetermined portions of a thread spools of predetermined types; and a fitting portion 16 formed, on a central area of the lower surface thereof, adapted to fit in a predetermined mounting hole 5*a* (see FIG. 4) of the thread stand plate 5. Preferably, the supporting portions 10, 11 and 13 of the connection member 7 in the instant embodiment have shapes adapted to support predetermined portions of thread spools of at least two predetermined types. Namely, the above-mentioned supporting section includes a first annular supporting concave portion 13 formed around the cylindrical portion 12, an annular convex portion 11 formed around the first annular supporting concave portion 13, and a second annular (or flange-shaped) supporting concave portion 10 formed around the annular convex portion 11.

Figure 5A:
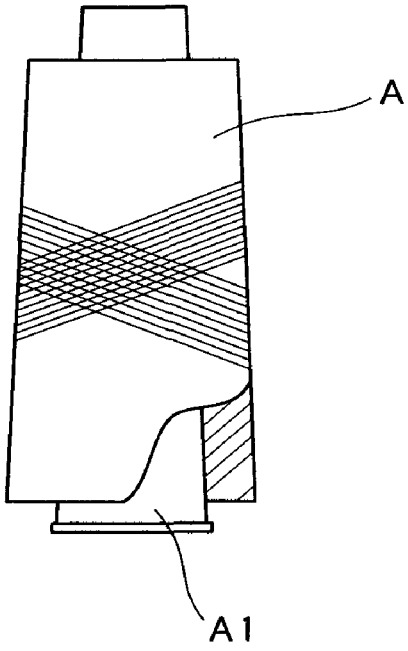
FIGS. 5A-5C are side views showing thread spools of three different types applicable to the embodiment of the thread stand.
Figure 5B:
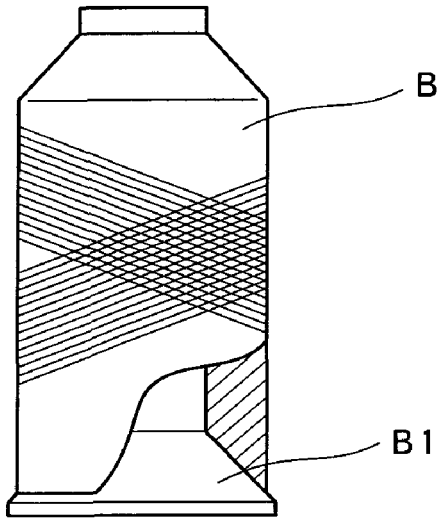
Figure 5C:
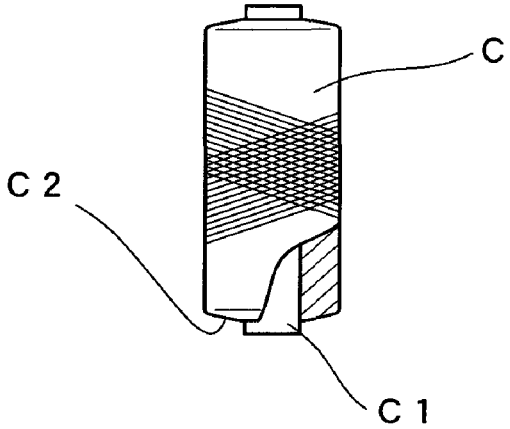

The thread stand 6 according to the instant embodiment are constructed to appropriately handle (i.e., to be capable of vertically fixing in a stable condition) any one of three different types of thread spools A, B and C as illustrated in FIGS. 5A-5C. In the thread spool A of the type shown in FIG. 5A, the winding core having an upper thread wound thereon is in the form of a tapered cone A1. In the thread spool B of the type of FIG. 5B, a principal section of the winding core having an upper thread wound thereon is in the form of a cylinder of a relatively great diameter. Lower portion (supporting flange) B1 of the winding core has a tapered shape flaring like a skirt. With the skirt-like lower portion (supporting flange) B1, there can be achieved the advantage that a thread portion slacking and sagging is prevented from getting caught by the lower end of the thread spool. In the thread spool C of the type shown in FIG. 5C, the winding core having an upper thread wound thereon is in the form of a cylinder of a relatively small cylinder. Here, the lower end or bottom of the winding core A1 of the thread spool A has a diameter greater than the lower end of the winding core C1 of the thread spool C, but smaller than the bottom of the winding core (support flange B1) of the thread spool B.

Referring back to FIG. 3A, the first supporting concave portion 13 has a size adapted to receive and support the lower end of the winding core C1 of the thread spool C having the smallest diameter, and the second supporting concave portion 10 has a size adapted to receive and support the lower end of the winding core A1 of the thread spool A greater in diameter than the thread spool C. As will be later described, if the thread spool C is set on the thread stand 6, the lower end C2 (see FIG. 5C) of the thread wound on the spool C can be received and supported by the convex portion 11 formed around the first supporting concave portion 13.

The cylindrical portion 12 formed on the central area of the upper surface of the connection member 7 has an upwardly-opening hole 12*a* in which one end portion (base portion) of the spool pin 8 can be inserted. Further, as shown in FIG. 3B, the fitting portion 16 is formed on the connection member 7 in coaxial positional relation to the cylindrical portion 12 and projects downwardly from the central region of the lower surface of the connection member 7. The fitting portion 16, which is constructed so as to close the lower side of the hole 12*a* of the cylindrical portion 12, has four radial slits to function as four resilient flexing pieces 16*a* as will be later described.

As illustrated in FIG. 3C, the lower end of the spool pin 8 is formed as a rounded portion 8*a*, and the spool pin 8 also has an annular groove 8*b* formed immediately above the rounded portion 8*a*. The spool pin 8 is formed, for example, of synthetic resin and has a lower tapered portion 8*c* tapered downwardly from a position indicated by arrow X, displaced from the longitudinal middle of the spool pin 8 toward the pin's lower end or rounded portion 8*a*; the purpose of such downward tapering is to allow the spool pin 8 to be fitted in the cylindrical portion 12 with sufficient tightness. Further, the spool pin 8 has an upper tapered portion 8*d* tapered upwardly from a position indicated by arrow Y, displaced from the longitudinal middle of the spool pin 8 toward the pin's upper end; the purpose of such upward tapering is to allow an umbrella member 20 (see FIGS. 6A-6C) to be fitted on the spool pin 8 with sufficient tightness.

As shown in sectional views of FIGS. 4A-4D, each of the above-mentioned resilient flexing pieces 16*a* has a curved lower-end inner surface to function as a curved engaging surface 17*a* that is deformed outwardly by abutting engagement with the lower-end rounded portion 8*a* of the spool pin 8, and it also has a lower-end locking portion 17*b* that engages with the annular groove 8*b* formed in the spool pin 8.

Figure 4A:
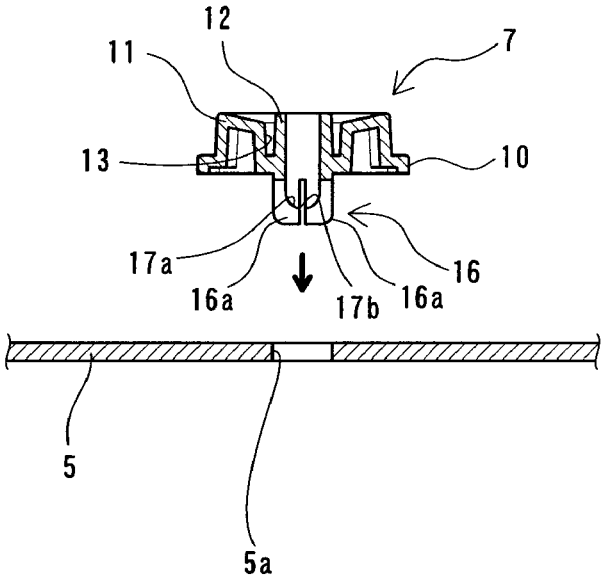
FIGS. 4A-4D are sectional views showing an operational sequence for attaching the embodiment of the thread stand to the thread stand plate.
Figure 4B:
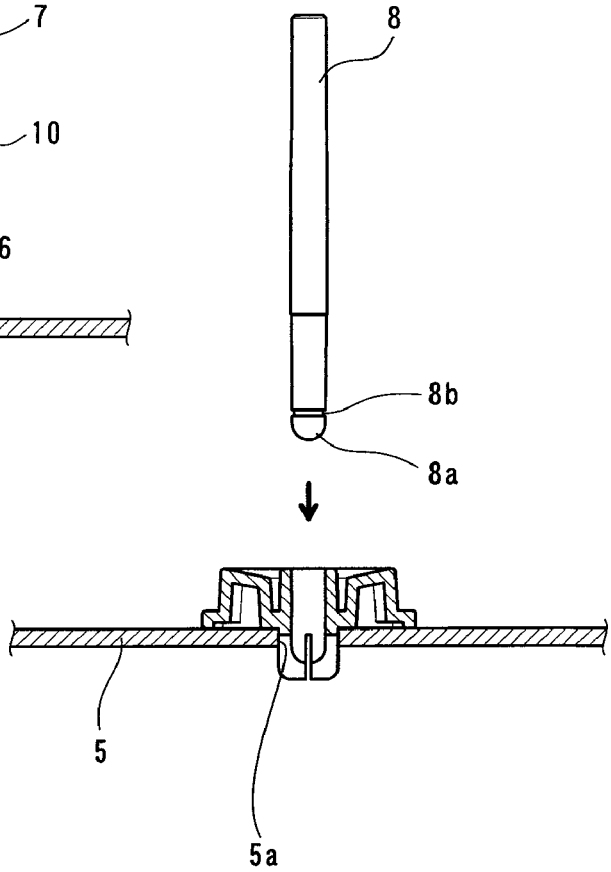
Figure 4C:
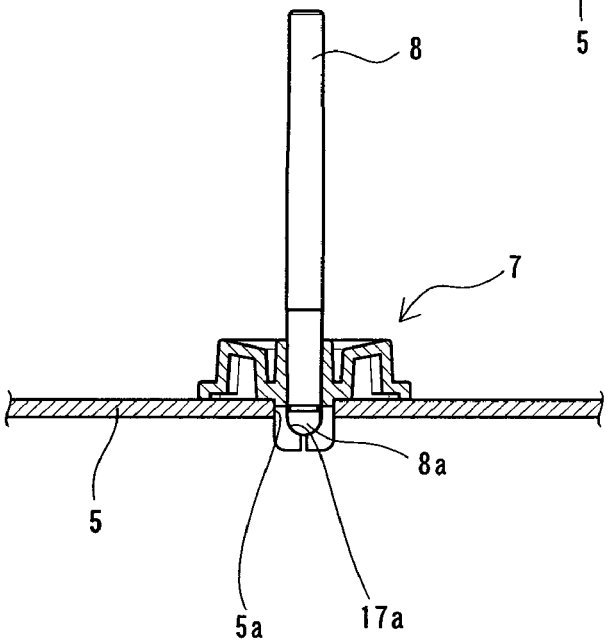
Figure 4D:
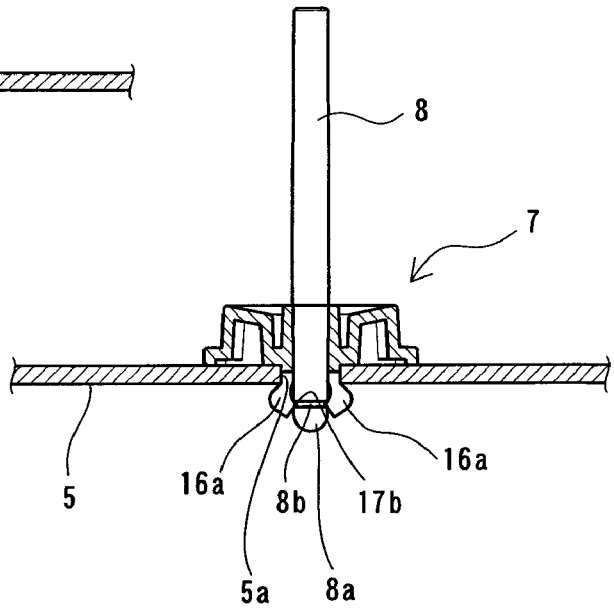

FIGS. 4A-4D are sectional views showing an operational sequence for attaching the thread stand 6 to the thread stand plate 5 of the sewing machine. First, the fitting portion 16 of the connection member 7 is fitted into the mounting hole 5*a* of the thread stand plate 5, to thereby attach the connection member 7 to thread stand plate 5, as shown in FIG. 4A. Then, a lower end portion of the spool pin 8 is inserted from above into the cylindrical portion 12 of the connection member 7, as shown in FIG. 4B. Then, the spool pin 8 is pushed downward until the lower-end rounded portion 8*a* abuts against the lower-end inner surfaces 17*a* of the individual resilient flexing pieces 16*a* as shown in FIG. 4C. Then, as the spool pin 8 is pushed further downward, the four resilient flexing pieces 16*a* are pushed or bulged outwardly away from one another by the lower-end rounded portion 8*a*, after which the lower-end locking portion 17*b* engages with the annular groove 8*b* of the spool pin 8, as shown in FIG. 4D, to thereby prevent further downward movement of the spool pin 8. In this manner, the spool pin 8 can be integrally coupled with the connection member 7, and the connection member 7 can be firmly fixed to the thread stamp plate 5 by the outward bulging of the resilient flexing pieces 16*a*. Thus, both the spool pin 8 and the connection member 7 can be firmly fixed together to the thread stamp plate 5 with only a simple operation of inserting the spool pin 8 into the connection member 7.

Next, with reference to FIGS. 6A-6C, a description will be given about how a desired one of the different types of thread spools A-C is set on the thread stand 6 attached to the thread stand plate 5 in the aforementioned manner.

Figure 6A:
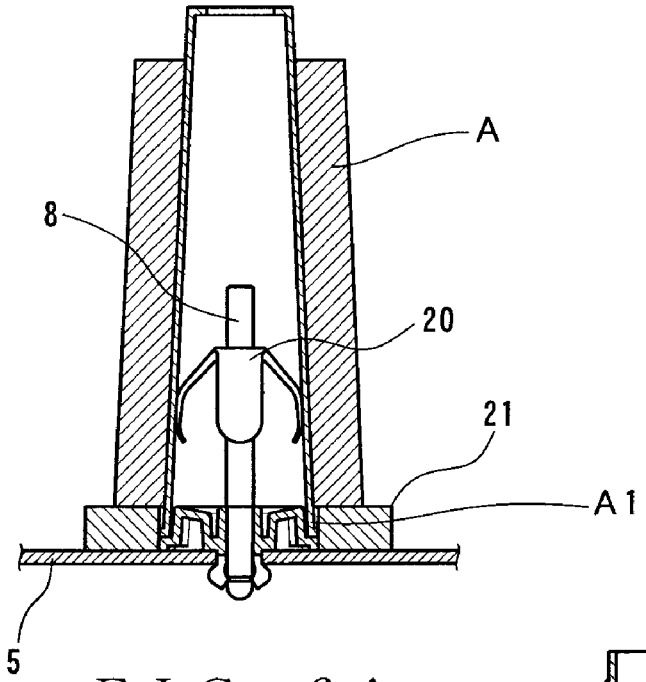
FIGS. 6A-6C are sectional views showing the various thread spools set on the embodiment of the thread stand.

FIG. 6A is a sectional view showing the thread spool A, which is of the type shown in FIG. 5A, set on the thread stand 6. In this case, the lower end of the winding core A1 of the thread spool A is received and supported in the second supporting concave portion 10 that is capable of supporting a winding core of a great diameter on the connection member 7, so that undesired shaking movement of the thread spool A set on the thread stand 6 can be prevented. In FIG. 6A, the umbrella member 20 of the conventionally-known construction is mounted on the spool pin 8, as a preferred example. Namely, the umbrella member 20 has an axial mounting hole (not shown) formed centrally therein, and four vanes capable of being resiliently spread out into a predetermined imaginary diameter. The umbrella member 20 is inserted, at its axial mounting hole, onto the spool pin 8 from the upper end of the pin 8, and it is locked at a suitable height by means of the upper tapered portion 8*d* (FIG. 3C). With the vanes of the umbrella member 20 resiliently abuttingly supporting the winding core A1 of the thread spool A from the interior of the core A1, the thread spool A set on the thread stand 6 can be fixed even more stably. FIG. 6A also shows a supporting ring 21 detachably attached to the connection member 7 along the outer periphery of the connection member 7. The lower end of the thread wound on the spool A can be supported on the supporting ring 21, so that undesired sagging of the thread can be prevented as conventionally known. Note that either or both of the umbrella member 20 and supporting ring 21 may be dispensed with if desired.

Figure 6B:
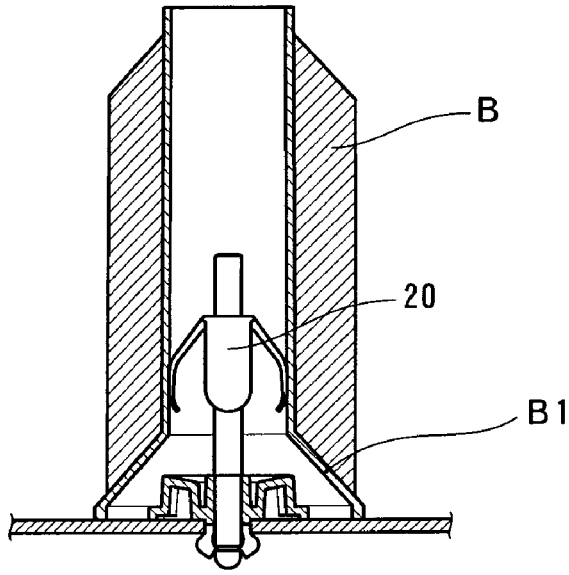
Figure 6C:
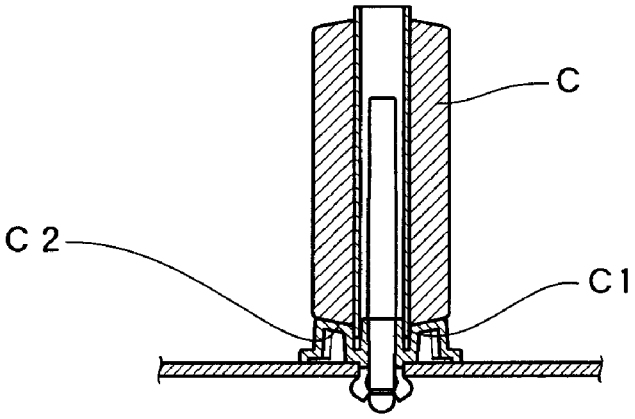
Figure 7:
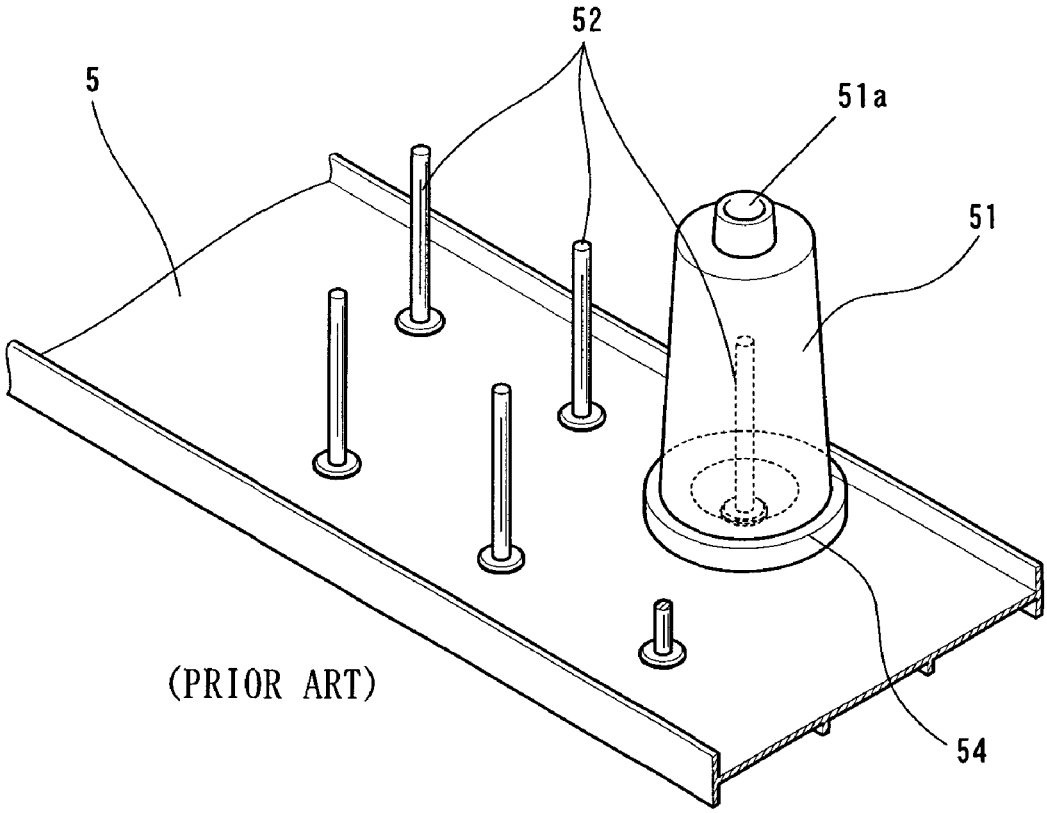
FIG. 7 is a perspective view showing a conventionally-known thread stand mounted on a thread stand plate.
Figure 8:
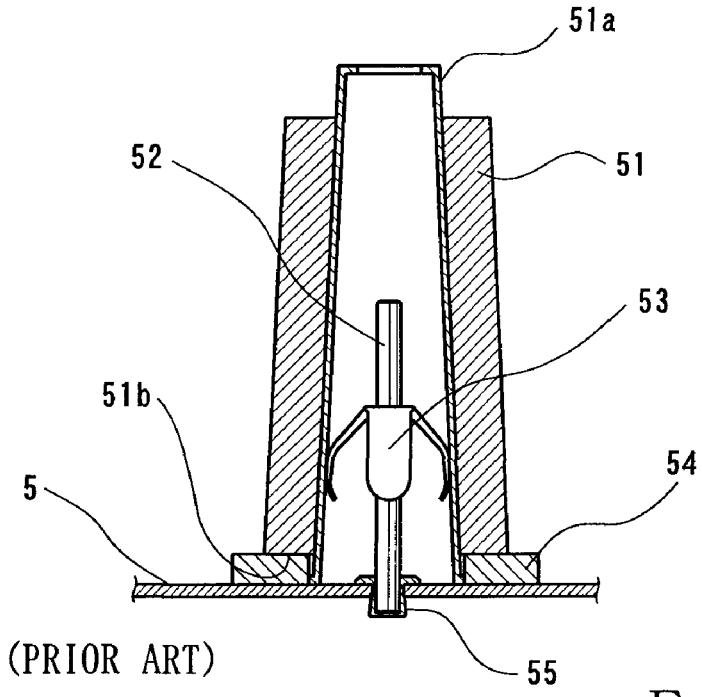
FIG. 8 is a perspective view showing a thread spool set on the conventionally-known thread stand of FIG. 7.

FIG. 6C is a sectional view showing the thread spool C, which is of the type shown FIG. 5C, set on the thread stand 6. In this case, the lower end of the winding core C1 of the thread spool C is received and supported in the first supporting concave portion 13 that is capable of supporting a winding core of a small diameter on the connection member 7, so that undesired shaking movement of the thread spool C set on the thread stand 6 can be prevented. The lower end of the thread wound on the thread spool C can be received and supported on the convex portion 11 surrounding the first supporting concave portion 13 of the connection member 7, so that undesired sagging of the thread can be prevented.

FIG. 6B is a sectional view showing the thread spool B, which is of the type shown in FIG. 5B, set on the thread stand 6. The thread spool B of this type, where the bottom of the winding core B1 has a diameter than the outer diameter of the connection member 7, has no portion capable of being supported by the supporting portions 10. 11 and 13 of the connection member 7. Thus, the umbrella member 20 is mounted on the spool pin 8 so that the vanes of the umbrella member 20 abuttingly support a small-diameter portion of the winding core B1 of the thread spool B from the interior of the core B1, with the result that the thread spool B set on the thread stand 6 can be fixed even more stably. Although the arrangements shown in FIGS. 6B and 6C can both prevent undesired sagging of the thread even if there is not provided the supporting ring 21 of FIG. 6A, the thread spools B and C may each be set on the thread stand 6 with the supporting ring 21 interposed between the spool and the stand 6.

Whereas, in the above-described embodiment, the cylindrical portion 12 and the fitting portion 16 are formed on the connection member 7 in coaxial positional relation to each other, the present invention is not so limited, and fitting of the spool pin 8 into the connection member 7 and fitting of the fitting portion 16 into the thread stand plate 5 may be carried out through separate mechanisms instead of being carried out in interlocked relation to each other as in the above-described embodiment.

Further, in the above-described embodiment, the mounting portion of the thread stand plate 5, via which the thread stand 6 is attached to the thread stand plate 5, is formed as the mounting hole 5*a*. However, the present invention is not so limited, and the mounting portion of the thread stand plate 5 may be formed as a projection or the like, in which case the fitting portion 16 of the connection member 7 is fitted on the projection. Further, the spool pin 8 may be fitted on the outer peripheral surface of the cylindrical portion 12 instead of being fitted in the cylindrical portion 12.

It should be appreciated that the present invention is not limited to the described embodiment and various modifications of the invention are possible without departing from the basic principles of the invention.

This application is based on, and claims priority to, JP PA 2006-218842 filed on 10 Aug. 2006. The disclosure of the priority application, in its entirety, including the drawings, claims, and the specification thereof, is incorporated herein by reference.

What is claimed is:

1. A thread stand for attachment to a predetermined mounting portion of a thread stand section of a sewing machine to hold a thread spool substantially upright thereon, said thread stand comprising:

a rod member; and a connection member integrally including: a supporting section having a shape adapted to support a predetermined portion of a thread spool of a predetermined shape; a cylindrical portion for fixing said rod member to said connection member by allowing one end portion of said rod member to fittingly engage therewith; and a fitting portion fittingly engageable with the predetermined mounting portion of said thread stand section of the sewing machine, wherein said connection member and said rod member are attached together to the thread stand section of the sewing machine with said connection member attached to the mounting portion of the thread stand section via said fitting portion and said rod member inserted at the one end portion into or onto said cylindrical portion, wherein said supporting section has a shape adapted to support predetermined portions of thread spools of at least two types having different configurations, wherein said thread spools of at least two types are a thread spool of a predetermined first type and a thread spool of a predetermined second type, and a bottom of the thread spool of said first type has a diameter smaller than a bottom of the thread spool of said second type, and wherein said supporting section includes a first supporting concave portion formed around said cylindrical portion, a convex portion formed around said first supporting concave portion, and a second supporting concave portion formed around the convex portion, said first supporting concave portion having a size adapted to receive a lower end of the thread spool of said first type, said second supporting concave portion having a size adapted to receive a lower end of the thread spool of said second type.

2. A thread stand as claimed in claim 1 wherein said convex portion is adapted to support a lower end of a thread wound on the thread spool of said first type.

3. A thread stand as claimed in claim 1 which further comprises a supporting ring detachably attachable along an outer periphery of said connection member, and wherein said supporting ring is adapted to support a lower end of a thread wound on the thread spool of said second type.

4. A thread stand as claimed in claim 1 which further comprises an umbrella member detachably attachable to said rod member and having resilient vanes capable of being resiliently spread out into a predetermined imaginary diameter, and wherein the vanes of said umbrella member is capable of resiliently abuttingly supporting a winding core of the thread spool from the interior of the winding core.

5. A thread stand as claimed in claim 4 wherein a thread spool of a particular type having no portion capable of being supported by said supporting section of said connection member can be held substantially upright on said thread stand by the vanes of said umbrella member resiliently abuttingly supporting a winding core of the thread spool of the particular type from the interior of the winding core.

6. A thread stand as claimed in claim 1 wherein said cylindrical portion and said fitting portion are formed, on said connection member, in coaxial positional relation to each other, and, when the one end portion of said rod member is inserted into or onto said cylindrical portion, said fitting portion resiliently deforms, due to a fitting force given by said rod member, into tight fitting engagement with the predetermined mounting portion of the thread stand section of the sewing machine, so that said connection member and said rod member are tightly fixed to the thread stand section.

* * * * *